US009240189B2

(12) United States Patent
Ambrose et al.

(10) Patent No.: US 9,240,189 B2
(45) Date of Patent: Jan. 19, 2016

(54) REAL-TIME SCHEDULING METHOD WITH REDUCED INPUT/OUTPUT LATENCY AND IMPROVED TOLERANCE FOR VARIABLE PROCESSING TIME

(71) Applicant: Texas Instruments Incorporated, Dallas, TX (US)

(72) Inventors: Martin Jeffrey Ambrose, Missouri City, TX (US); Lester Anderson Longley, Atlanta, GA (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 79 days.

(21) Appl. No.: 14/149,981

(22) Filed: Jan. 8, 2014

(65) Prior Publication Data

US 2014/0257823 A1 Sep. 11, 2014

Related U.S. Application Data

(60) Provisional application No. 61/774,301, filed on Mar. 7, 2013.

(51) Int. Cl.
*G10L 19/00* (2013.01)

(52) U.S. Cl.
CPC ..... *G10L 19/00* (2013.01)

(58) Field of Classification Search
CPC ..... G10L 19/00
USPC ..... 704/500
See application file for complete search history.

(56) References Cited

U.S. PATENT DOCUMENTS

| | | | | |
|---|---|---|---|---|
| 2003/0125933 | A1* | 7/2003 | Saunders et al. | 704/201 |
| 2008/0120097 | A1* | 5/2008 | Fleishman et al. | 704/212 |
| 2009/0171674 | A1* | 7/2009 | Mitsumori | 704/500 |

* cited by examiner

*Primary Examiner* — Qian Yang
(74) *Attorney, Agent, or Firm* — Robert D. Marshall, Jr.; Frank D. Cimino

(57) ABSTRACT

A method and apparatus for processing encoded audio data that operates on batches of data having a predetermined time block size. An input/output memory buffer provides a delay from input to corresponding output of 2+x time blocks where x is a predetermined constant and 0<x<1.

13 Claims, 13 Drawing Sheets

REAL-TIME SCHEDULING METHOD WITH REDUCED INPUT/OUTPUT LATENCY AND IMPROVED TOLERANCE FOR VARIABLE PROCESSING TIME

CLAIM OF PRIORITY

This application claims priority under 35 U.S.C. 119(e)(1) to U.S. Provisional Application No. 61/774,301 filed Mar. 7, 2013.

TECHNICAL FIELD OF THE INVENTION

The technical field of this invention is real time audio/video data processing.

BACKGROUND OF THE INVENTION

The field of this invention is real time audio/video processing. Media files are often delivered for streaming or stored for consumption using compressed data formats. Playing this media data requires decoding/decompressing. This decoding/decompressing should be done in real time while the user is listening to the recovered audio data or watching the recovered video data. Once playing begins any interrupt of flow is generally considered unacceptable by the user.

There are two separate aspects of data processing that might cause problems. The first problem is with computational latency. The decoding/decompressing process requires data processing time. Thus there is a delay in playing audio/video file. The second problem is variability. Most compression techniques provide variable compression dependent upon the nature of the audio/video file being compressed. In addition some parts of the compression technique require varying amounts of data processing for decompression. The variable data rate and variable required data processing for decompression causes variable latency.

There is another artifact of the data processing in decoding/decompressing. The required data processing is generally very serial for each input data sample. Performing the entire serial chain processing for a single sample at a time is considered disadvantageous. Generally these data processing operations operate upon a block of samples. This process generally requires buffering data samples before and after data processing each block of samples.

SUMMARY OF THE INVENTION

The problem of this invention is providing suitable latency and robust response to the inherent variability of the latency.

BRIEF DESCRIPTION OF THE DRAWINGS

These and other aspects of this invention are illustrated in the drawings, in which.

DETAILED DESCRIPTION OF PREFERRED EMBODIMENTS

Input/Output Latency is a key performance characteristic of audio/video products. Proper matching the audio latency with the video latency is required to achieve required lip sync in the output. Algorithms for such products are typically implemented on embedded processors. These embedded processors typically operate on blocks of samples rather than on a sample-by-sample basis. Sample-by-sample operation would provide minimal latency but results in poor processor utilization. The data processing in these systems involves a serial chain of operations. Processing on a sample-by-sample basis would thus include task switching many times. Each task switch typically includes a task switch penalty. Processing upon batches of samples minimizes this task switch penalty at the expense of increased latency. This invention reduces the latency associated with block processing while maintaining the performance benefits associated with block processing.

Audio/Video systems require deterministic input-to-output latency. This is typically achieved by starting transmission of output samples with a fixed timing relationship relative to the arrival of input samples. Human perception of audio/video synchronization limits this latency to less than a prescribed threshold. Sufficient latency must be provided in these systems for processing to be completed without output starvation.

Prior to this invention, this latency between input and output was required to be an integral number of sample blocks. The invention employs a fractional block of samples. This controls the input/output timing relationship with a finer granularity than previous methods. This finer granularity allows intermediate choices for latency which can satisfy both competing constraints. The invention allows latency to be reduced to more perceptually acceptable levels, while still meeting real-time processing deadlines. This invention involves framework architecture changes to reduce processing latency. This is especially important for systems having multi-processor cascades.

Figure 1:
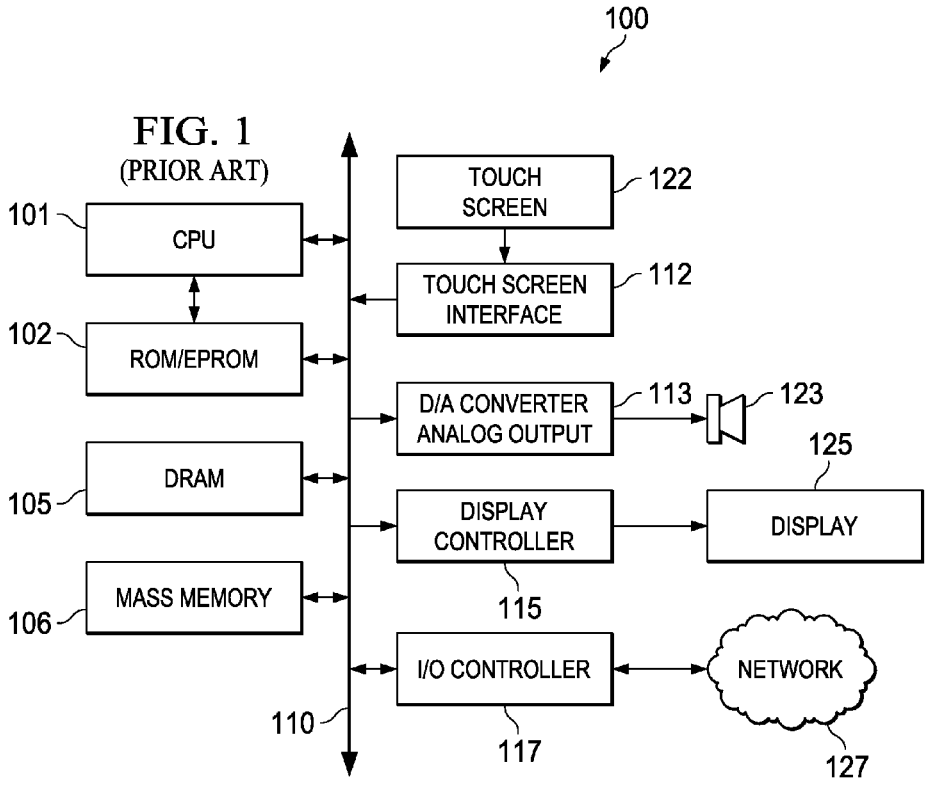
FIG. 1 (PRIOR ART)
FIG. 1 is a block diagram illustrating an embodiment of a data processing system to which this invention is applicable.

FIG. 1 illustrates a block diagram of a digital audio/video system 100. The audio/video system 100 stores digital audio/video files on mass memory 106. These files could be music videos, television programs or theatrical movies. Mass memory 106 can be a hard disk drive, a compact disk drive accommodating a compact disk or some other data reading device capable of extracting digital data from a removable data carrier. These digital audio/video files may be in a compressed digital format such as MPEP (video) or MP3 (audio). Digital audio and video are recalled in proper order, synchronized and presented to the user via speakers 123 and display 125. FIG. 1 illustrates only a single speaker 123 but those skilled in the art would realize it is customary to supply left and right channel signals to a pair of speakers or alternately to supply surround sound to more than two speakers. For example portable system speakers 123 could take the form of a set of headphones known as earbuds. Digital audio/video system 100 includes: core components central processing unit (CPU) 101, ROM/EPROM 102 or other nonvolatile memory such as FLASH; DRAM 105; mass memory 106; system bus 110; touch screen interface 112; touch screen 122; D/A converter and analog output 113; speaker 123; display controller 115; I/O controller 117; and display 125. CPU 101 acts as the controller of system 100 giving the system its character. CPU 101 operates according to programs stored in ROM/EPROM 102. Read only memory (ROM) is fixed upon manufacture. Erasable programmable read only memory (EPROM) may be changed following manufacture even in the hands of the consumer in the field. As an example, following purchase the consumer may desire to change functionality of the system. The suitable control program is loaded into EPROM. Suitable programs in ROM/EPROM 102 include the user interaction programs, which are how the system responds to inputs from touch screen 122 and displays information on display 125, the manner of fetching and controlling files from mass memory 106, interaction with the network 127 via I/O controller 117 and the like. A typical system may include both ROM and EPROM.

System bus 110 serves as the backbone of digital audio/video system 100. Major data movement within digital audio/video system 100 occurs via system bus 110.

Mass memory 106 moves data to system bus 110 under control of CPU 101. This data movement would enable recall of digital audio/video data from mass memory 106 for presentation to the user.

Touch screen interface 112 mediates user input from touch screen 122. Touch screen 122 typically overlays display and includes touch sensors for user input. Touch screen interface 112 senses these screen touches from touch screen 122 and signals CPU 101 of the user input. Touch screen interface 112 typically encodes the screen touch in a code that can be read by CPU 101. Touch screen interface 112 may signal a user input by transmitting an interrupt to CPU 101 via an interrupt line (not shown). CPU 101 can then read the input key code and take appropriate action. Touch screen interface 112 and touch screen 122 could be replaced by any suitable device for inputting user data such as buttons, a keyboard, a joystick or a touch pad.

Digital to analog (D/A) converter and analog output 113 receives the digital audio/video data from mass memory 106. Digital to analog (D/A) converter and analog output 113 provides an analog signal to speakers 123 for listening by the user. Speakers 123 is any suitable electrical to sound transducer including loud speakers, headphones and earbuds.

Display controller 115 controls the display shown to the user via display 125. Display controller 115 receives data from CPU 101 via system bus 110 to control the display. Display 125 is typically a multiline liquid crystal display (LCD). This display typically may also be used to facilitate input of user commands by outlining touch areas for the touch screen input. In a portable system, display 125 would typically be located in a front panel of the device.

I/O controller 117 enables digital audio/video system 100 to exchange messages and data with network 127. As an example, I/O controller 117 could permit digital audio/video system 100 to log on to an Internet site, request a file or data stream and receive delivery via network 127.

DRAM 105 provides the major volatile data storage for the system. This may include the machine state as controlled by CPU 101. Typically data is recalled from mass memory 105 or received from network 127 via I/O controller 117, and buffered in DRAM 105 before decompression by CPU 101. DRAM 105 may also be used to store intermediate results of the decompression.

In operation the user specifies an action to be taken by digital audio/video system 100 via inputs on touch screen 122.

Figure 2:
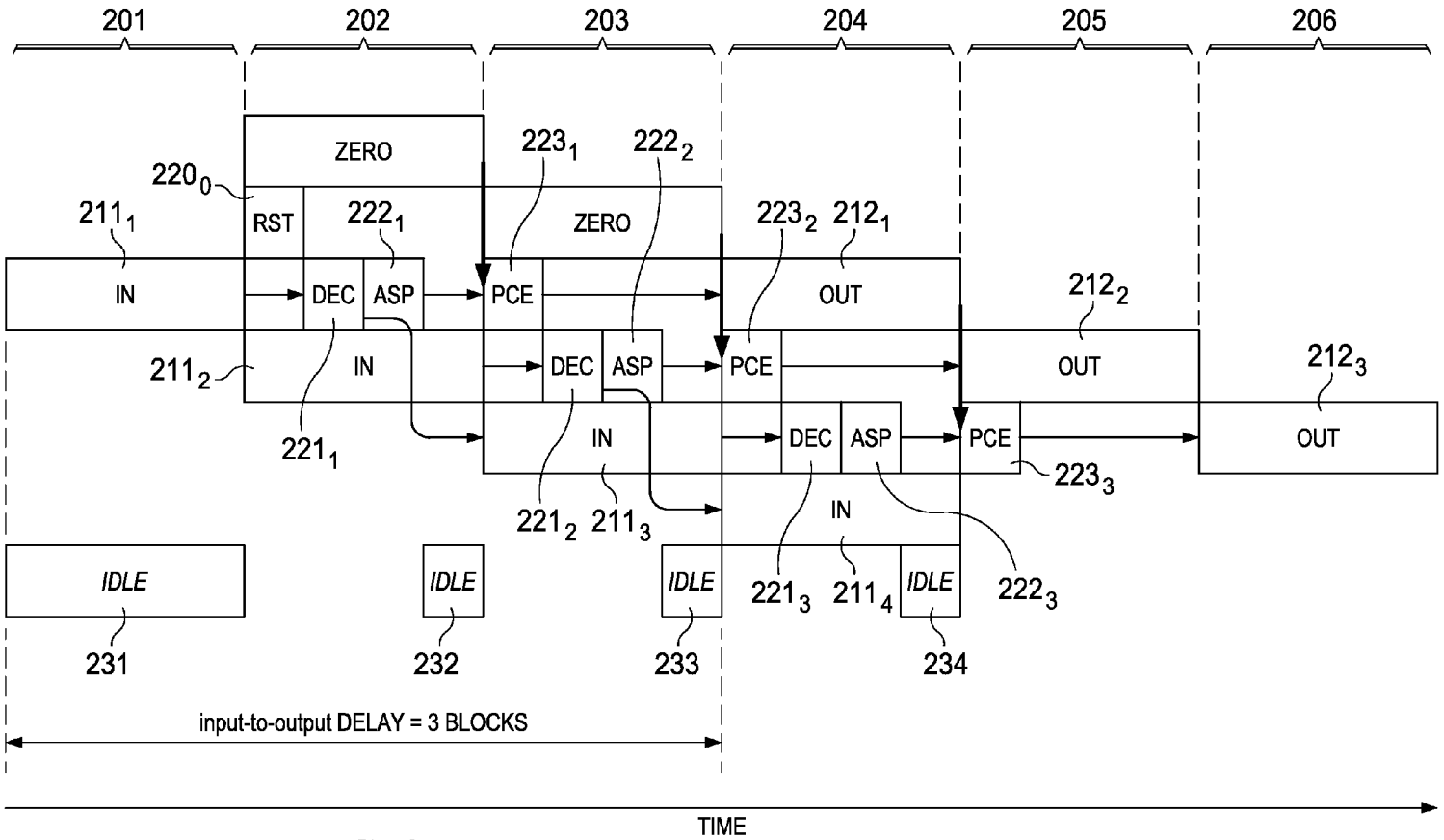
FIG. 2 (PRIOR ART)
FIG. 2 illustrates an example startup schedule with the output buffer pre-loaded with two blocks in a three block buffer case.

FIG. 2 illustrates a typical example of processing using three block sized buffers. Processing begins with one block sized buffer receiving input data and two zero filled block sized buffers for output. Each horizontal row of FIG. 2 shows successive processing stages including buffers and data processing for a given block of samples. FIG. 2 is divided into block sized time blocks 201 to 206. FIG. 2 illustrates initial decoder operation.

The decoding processing begins during time block 201. During time block 201, a buffer $\mathbf{211}_1$ receives and stores input data. Buffer $\mathbf{211}_1$ is typically a designated portion of DRAM 105. As previously noted this input data could be from mass memory 106 or from network 127 via I/O controller 117. CPU 101 is idle during time block 201 as indicated by idle block 231.

During time block 202, CPU 101 initiates the process via reset (RST) block $\mathbf{220}_0$. This occurs only once at the start of the process. CPU 101 next executes decode (DEC) block $\mathbf{221}_1$. This involves reading data from buffer $\mathbf{211}_1$ as illustrated in FIG. 2 then decoding and decompressing this data. As noted in FIG. 2, decode (DEC) block $\mathbf{221}_1$ must complete before the beginning of time block 203 so that buffer $\mathbf{211}_1$ is available to receive and store new input data. CPU 101 next executes audio stream processing (ASP) block $\mathbf{222}_1$. This involves further processing on data from decode (DEC) block $\mathbf{221}_1$. CPU 101 is idle (or executing background processing) for the last of time block 202 in this example as shown at idle block 232. Buffer $\mathbf{211}_2$ is being filled with a second block of input data during time block 202.

During time block 203, CPU 101 performs pulse code modulation (PCM) encode (PCE) at PCE block $\mathbf{223}_1$. PCE block $\mathbf{223}_1$ produces digital signals for supply to D/A converter and analog output 113 to supply an analog signal to speaker 123. As illustrated in FIG. 2 data from PCE block $\mathbf{223}_1$ is stored in buffer $\mathbf{212}_1$. CPU 101 next executes DEC block $\mathbf{221}_2$ followed by ASP block $\mathbf{222}_2$ on the second block of input data. CPU 101 is idle during idle block 233. Buffer $\mathbf{211}_3$ is being filled with a third block of input data during time block 203.

During time block 204, data stored in buffer $\mathbf{212}_1$ is output to D/A converter and analog output 113. CPU 101 performs pulse code modulation (PCM) encode (PCE) at PCE block $223_2$ on the second block of input data. CPU 101 next executes DEC block $221_3$ followed by ASP block $223_3$ on the third block of input data. CPU 101 is idle during idle block 234. Buffer $211_4$ is being filled with a fourth block of input data during time block 204.

During time block 205, data stored in buffer $212_2$ is output to D/A converter and analog output 113. CPU 101 performs pulse code modulation (PCM) encode (PCE) at PCE block $223_2$ on the fourth block of input data.

Upon reaching a steady state such as illustrated in time block 204, the process includes the following. Data is loaded into one buffer as input buffer. Data is output from one buffer as output buffer. CPU 101 performs the needed data processing tasks. FIG. 2 illustrates the delay from arrival of an input sample to the output of a processed version of that sample is 3 blocks of time. This time $\Delta_{IO}$ is thus given by:

$$\Delta_{IO}=3N/f_s$$

where: N is number of samples per block; and $f_s$ is sampling rate. This is referred to as the system latency.

Two factors establish this delay. The first factor is that no processing is performed or output initiated until one block of input samples has arrived. The second factor is that the output is started with two blocks of zeros in output buffer immediately after the first input block arrives. The input and output buffers employed each have a size to hold two N-sample blocks.

There are three signal dependencies shown in FIG. 2. The first signal dependency is the input buffer memory being released following decode (DEC) processing for re-filling by an input driver. The second signal dependency is the sequential data-processing dependencies from the input buffer to decode (DEC) processing to audio stream processing (ASP) and then to the pulse code modulation (PCM) encode. The third signal dependency is the combined time from (1) pulse code modulation (PCM) encode (PCE) to the output buffer and (2) the wait for the output buffer to become available after being emptied by the output driver.

Figure 3A:
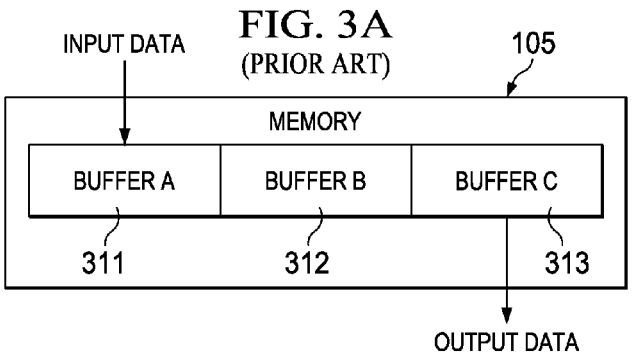
FIG. 3A (PRIOR ART)
FIGS. 3A, 3B and 3C illustrate respective examples of use of the three sample block buffers in the example illustrated in FIG. 2.
Figure 3B:
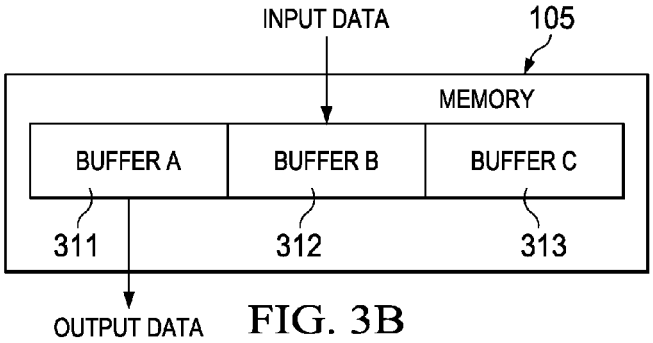
FIG. 3B (PRIOR ART)
Figure 3C:
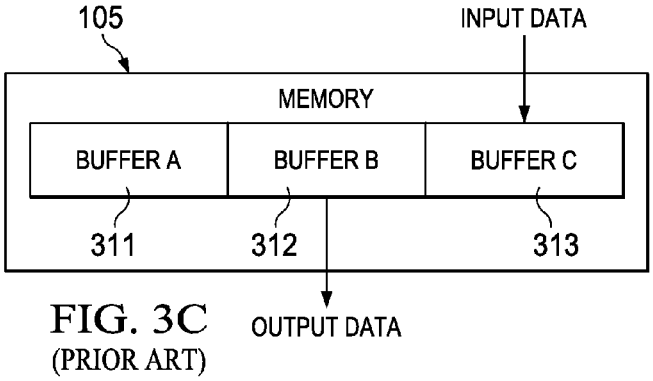
FIG. 3C (PRIOR ART)

FIGS. 3A, 3B and 3C illustrate an example of a prior art technique managing input and output buffers. FIG. 3A illustrates data movement during a first time block. FIG. 3A illustrates buffer A 311, buffer B 312 and buffer C 313 are formed as part of DRAM 105. During the first time block input data is written into buffer A 311 and output data is read from buffer C 313. FIG. 3B illustrates data movement during a second time block as input data is written into buffer B 312 and output data is read from buffer A 311. FIG. 3C illustrates data movement during a third time block as input data is written into buffer C 313 and output data is read from buffer B 312. This pattern repeats in FIG. 3A for the fourth time block. As shown in FIGS. 3A, 3B and 3C one buffer is used for input, one buffer is idle and one buffer is used for output.

Figure 4:
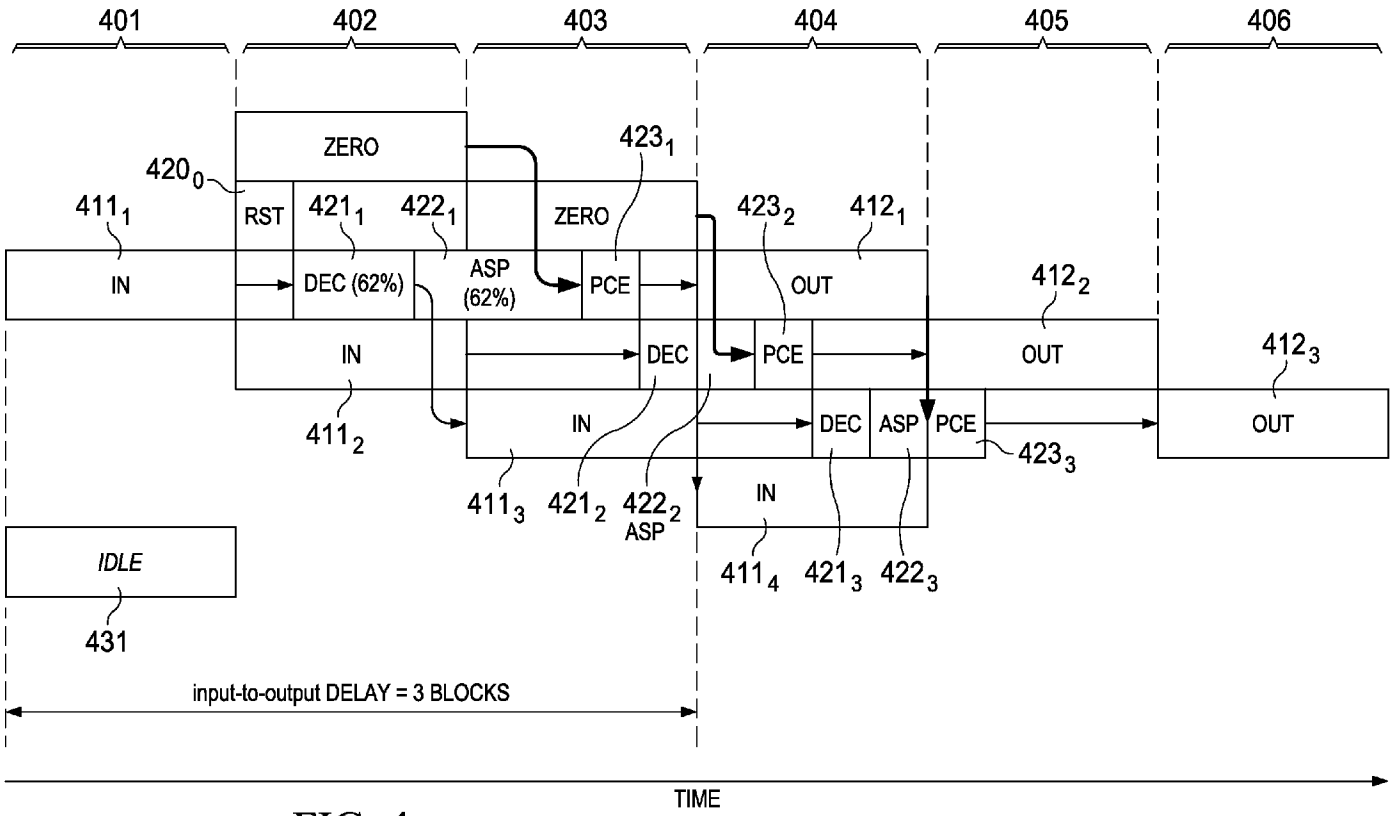
FIG. 4 (PRIOR ART)
FIG. 4 illustrates an example schedule with the output buffer pre-loaded with two blocks with the peak MIPS in an initial block in a three block buffer case.

FIG. 4 illustrates a further example of processing using three block sized buffers. FIG. 4 illustrates that CPU 101 required more time for the DEC and ASP processing than illustrated in FIG. 2. As noted above the processing time needed for these tasks is variable and any processing system must operate in light of that variability. The distribution of MIPS between DEC and ASP illustrated in FIG. 4 is even. This is not mandatory but is arbitrary. FIG. 4 illustrates this latter schedule is relatively tolerant of peak instruction cycles in DEC or ASP stages. The peak CPU load for the initial block is regarded as the worst case due to the one-time RST (Reset) activity.

During time block 401, a buffer $411_1$ receives and stores input data. CPU 101 is idle during time block 401 as indicated by idle block 431.

During time block 402, CPU 101 initiates the process via reset (RST) block $420_0$. This occurs only once at the start of the process. CPU 101 next executes decode (DEC) block $421_1$. This involves reading data from buffer $411_1$ as illustrated in FIG. 4. As noted in FIG. 4, decode (DEC) block $421_1$ must complete before the beginning of time block 403 so that buffer $411_1$ is available to receive and store new input data. CPU 101 next begins audio stream processing (ASP) block $422_1$ on the first block of data. This involves further processing on data from decode (DEC) block $421_1$. Buffer $411_2$ is being filled with a second block of input data during time block 402.

During time block 403, CPU 101 continues and completes audio stream processing (ASP) block $422_1$. CPU 101 then performs pulse code modulation (PCM) encode at PCE block $423_1$. This differs from FIG. 2 in that the audio signal processing (ASP) is not completed in the second data block. As noted above the actual constraints are that the decode (DEC) complete before the end of the second block 402 and that the pulse code modulation (PCM) encode complete before the beginning of the fourth block 404. Data from PCE block $423_1$ is stored in buffer $412_1$. CPU 101 next executes DEC block $421_2$ on the second block of input data. Buffer $411_3$ is being filled with a third block of input data during time block 403.

During time block 404, data stored in buffer $412_1$ is output to D/A converter and analog output 113. CPU 101 performs audio stream processing (ASP) block $422_2$ and pulse code modulation (PCM) encode (PCE) at PCE block $423_2$ on the second block of input data. CPU 101 next executes DEC block $421_3$ followed by ASP block $422_3$ on the third block of input data. Buffer $411_4$ is being filled with a fourth block of input data during time block 404.

During time block 405, data stored in buffer $412_2$ is output to D/A converter and analog output 113. CPU 101 performs pulse code modulation (PCM) encode (PCE) at PCE block $423_3$ on the third block of input data.

Figure 5:
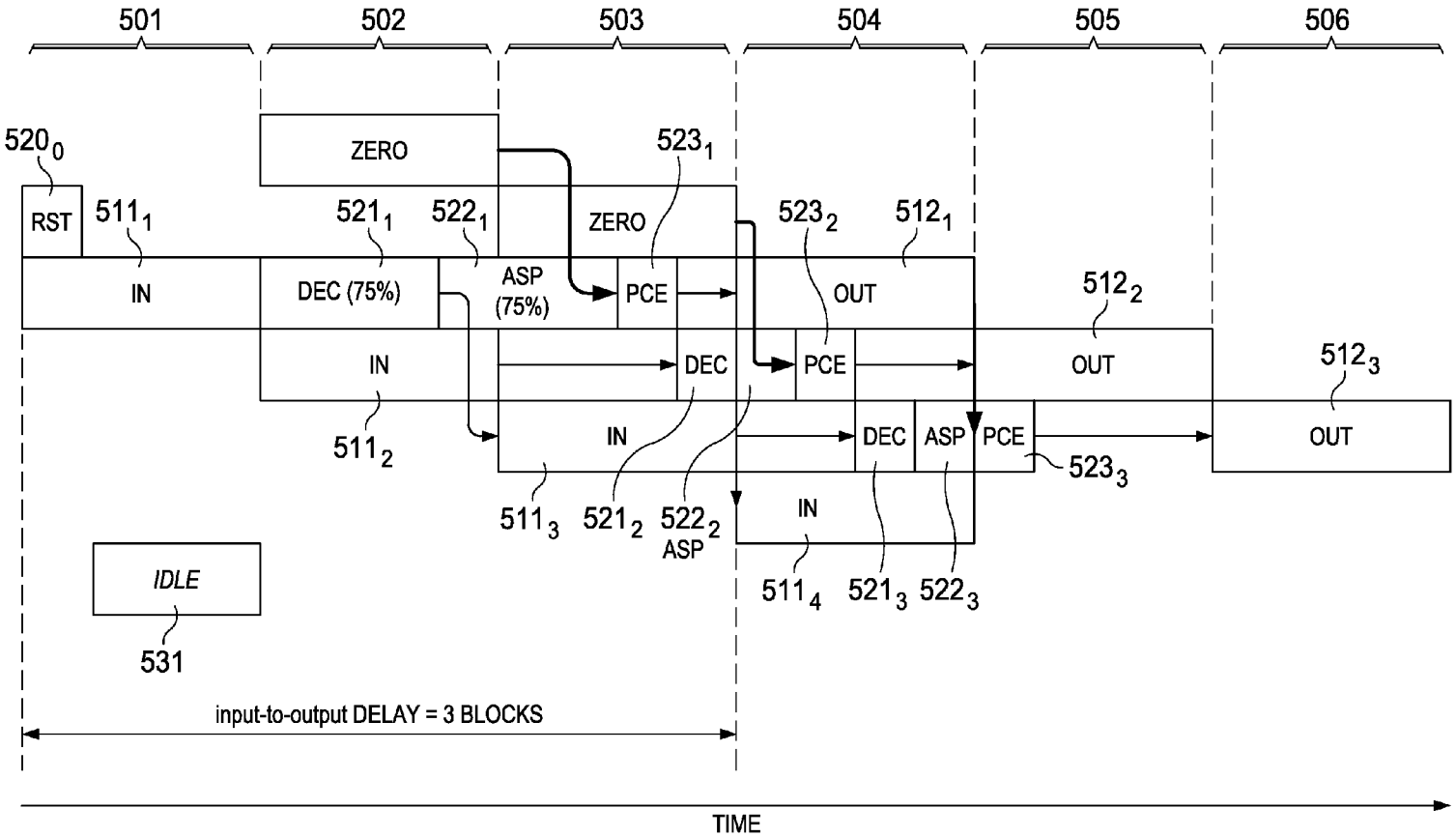
FIG. 5 (PRIOR ART)
FIG. 5 illustrates an example schedule with the output buffer pre-loaded with two blocks with the peak MIPS in initial block and an RST performed earlier in a three block buffer case.

FIG. 5 illustrates that the prior art 3 block process can accommodate further increases in the data processing time for the DEC and the ASP blocks than that illustrated in FIG. 4.

FIG. 5 illustrates another example where the initial peak DEC plus ASP instruction cycles are further increased. If PA/F processing is reorganized such that RST processing is completed before first IN block, then the dependency criteria is still satisfied.

During time block 501, a buffer $511_1$ receives and stores input data. CPU 101 performs the reset function at block $520_0$ and then is idle during remainder of time block 501 as indicated by idle block 531.

During time block 502, CPU 101 executes decode (DEC) block $521_1$. This involves reading data from buffer $511_1$ as illustrated in FIG. 5. Decode (DEC) block $521_1$ must complete before the beginning of time block 503 so that buffer $511_1$ is available to receive and store new input data. CPU 101 next begins audio stream processing (ASP) block $522_1$ on the first block of data. This involves further processing on data from decode (DEC) block $521_1$. Buffer $511_2$ is being filled with a second block of input data during time block 502.

During time block 503, CPU 101 continues and completes audio stream processing (ASP) block $522_1$. CPU 101 then performs pulse code modulation (PCM) encode at PCE block $523_1$. This differs from FIG. 2 in that the audio signal processing (ASP) is not completed in the second data block 502. As noted above the actual constraints are that the decode (DEC) complete before the start of the third block 503 and that the pulse code modulation (PCM) encode complete before the beginning of the fourth block 504. Data from PCE block $523_1$ is stored in buffer $512_1$. CPU 101 next executes DEC block $521_2$ on the second block of input data. Buffer $511_3$ is being filled with a third block of input data during time block 503.

During time block 504, data stored in buffer $512_1$ is output to D/A converter and analog output 113. CPU 101 performs audio stream processing (ASP) block $522_2$ and pulse code modulation (PCM) encode (PCE) at PCE block $523_2$ on the second block of input data. CPU 101 next executes DEC block $521_3$ followed by ASP block $522_3$ on the third block of input data. Buffer $511_4$ is being filled with a fourth block of input data during time block 504.

During time block 505, data stored in buffer $512_2$ is output to D/A converter and analog output 113. CPU 101 performs pulse code modulation (PCM) encode (PCE) at PCE block $523_3$ on the third block of input data.

As seen in FIG. 5 moving the reset (RST) block $520_0$ to time block 501 permits a further increase in the computational time of the initial DEC block and the ASP block. The peak DEC plus ASP instruction cycles illustrated in FIG. 5 can't be achieved in subsequent blocks. PCE must wait on output buffer memory to become available. Thus this technique fails in this case.

Figure 6:
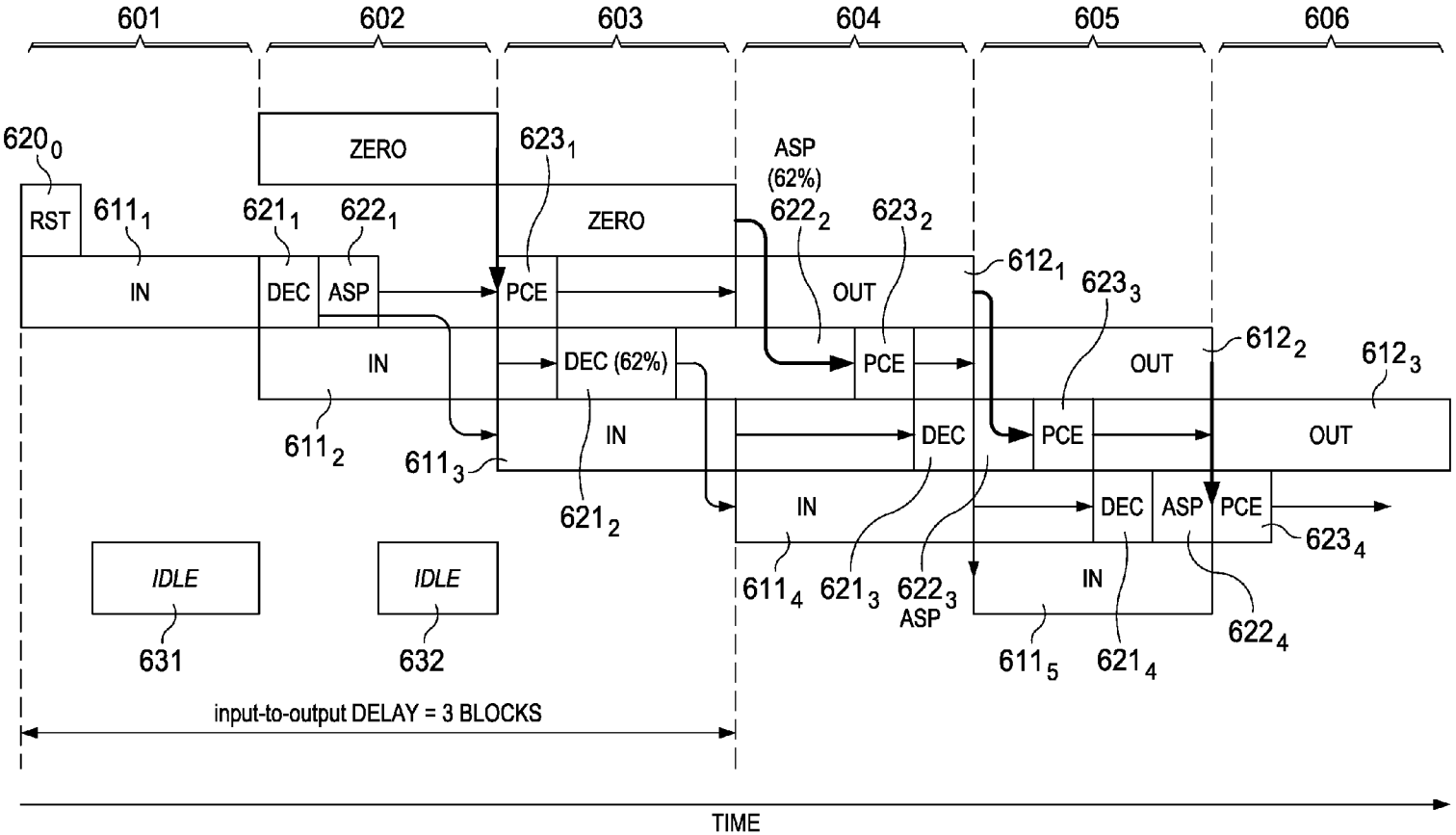
FIG. 6 (PRIOR ART)
FIG. 6 illustrates an example schedule with output buffer pre-loaded with two blocks with the peak MIPS in a subsequent block in a three block buffer case.

FIG. 6 illustrates a further example of input and output buffers storing three N-sample blocks. As shown in FIG. 6 still higher peak DEC plus ASP instruction cycles can be tolerated compared to FIG. 4 without worsening system latency.

During time block 601, a buffer $611_1$ receives and stores input data. CPU 101 performs the reset function at block $620_0$ and then is idle during remainder of time block 601 as indicated by idle block 631.

During time block 602, CPU 101 executes decode (DEC) block $621_1$. This involves reading data from buffer $611_1$ as illustrated in FIG. 6. Decode (DEC) block $621_1$ must complete before the beginning of time block 603 so that buffer $611_1$ is available to receive and store new input data. CPU 101 next begins audio stream processing (ASP) block $622_1$ on the first block of data. This involves further processing on data from decode (DEC) block $621_1$. CPU 101 is idle the remainder of time block 602 as shown at idle block 632. Buffer $611_2$ is being filled with a second block of input data during time block 602.

During time block 603, CPU 101 performs pulse code modulation (PCM) encode at PCE block $623_1$. PCE block $623_1$ must complete before the beginning of the fourth block 604. Data from PCE block $623_1$ is stored in buffer $612_1$. CPU 101 next executes DEC block $621_2$ on the second block of input data. Once this completes CPU 101 begins audio stream processing (ASP) block $622_1$ on the second block of data. As shown in FIG. 6 ASP block $622_1$ does not complete during time block 603 but continues during time block 604. Buffer $611_3$ is being filled with a third block of input data during time block 603.

During time block 604, data stored in buffer $612_1$ is output to D/A converter and analog output 113. CPU 101 completes audio stream processing (ASP) block $622_2$ and then performs pulse code modulation (PCM) encode (PCE) at PCE block $623_2$ on the second block of input data. CPU 101 next executes DEC block $621_3$ on the third block of input data. Buffer $611_4$ is being filled with a fourth block of input data during time block 604.

During time block 605, data stored in buffer $612_2$ is output to D/A converter and analog output 113. CPU 101 performs audio stream processing (ASP) $622_3$ on the third block of data. CPU 101 next performs pulse code modulation (PCM) encode (PCE) at PCE block $623_3$ on the third block of input data. The data from this operation is stored in buffer $612_2$. CPU 101 then executes decode (DEC) block $621_4$ followed by audio stream processing (ASP) block $622_4$. Buffer $611_5$ is being filled with the fifth block on input data.

During time block 606, data stored in buffer $612_3$ is output to D/A converter and analog output 113. CPU 101 performs pulse code modulation (PCM) encode (PCE) at PCE block $623_4$ on the fourth block of input data.

Figure 7:
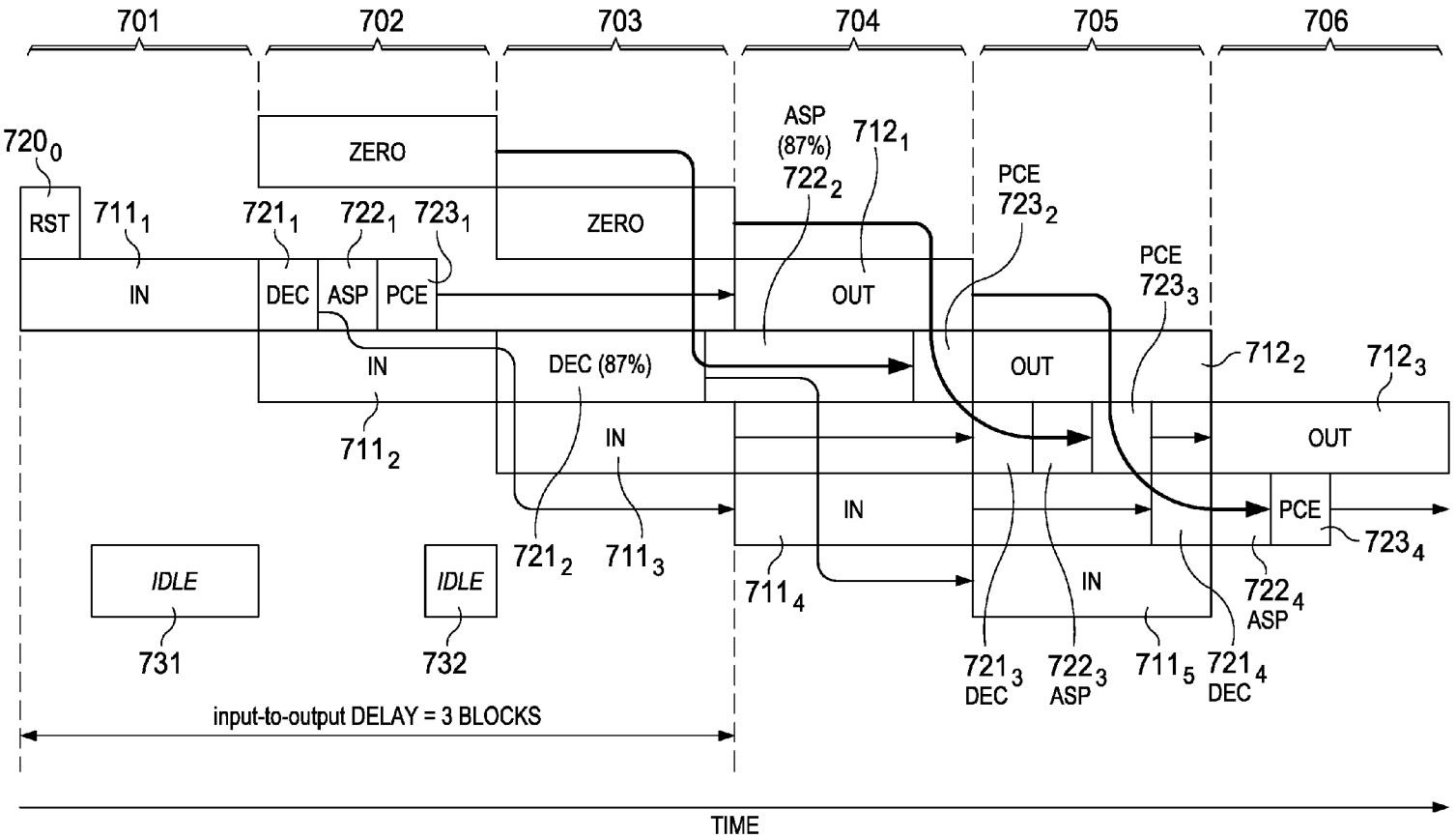
FIG. 7 (PRIOR ART)
FIG. 7 illustrates an example schedule with the output buffer pre-loaded with two blocks with the peak MIPS in a subsequent block including enlarged input and output buffers in a three block buffer case.

FIG. 7 illustrates a final example of input and output buffers storing three N-sample blocks. As shown in FIG. 7 still higher peak DEC plus ASP instruction cycles can be tolerated compared to FIG. 6 without worsening system latency.

During time block 701, a buffer $711_1$ receives and stores input data. CPU 101 performs the reset function at block $720_0$ and then is idle during remainder of time block 701 as indicated by idle block 731.

During time block 702, CPU 101 executes decode (DEC) block $721_1$ on the first block of data. CPU 101 next performs audio stream processing (ASP) block $722_1$ on the first block of data. This involves further processing on data from decode (DEC) block $721_1$. CPU 101 then performs pulse code modulation (PCM) encode (PCE) at PCE block $723_1$ on the first block of input data. CPU 101 is then idle the remainder of time block 702 as shown at idle block 732. Buffer $711_2$ is being filled with a second block of input data during time block 702.

During time block 703, CPU 101 executes DEC block $721_2$ on the second block of input data. Once this completes CPU 101 begins audio stream processing (ASP) block $722_2$ on the second block of data. As shown in FIG. 7 ASP block $722_1$ does not complete during time block 703 but continues during time block 704. Buffer $711_3$ is being filled with a third block of input data during time block 703.

During time block 704, data stored in buffer $712_1$ is output to D/A converter and analog output 113. CPU 101 completes audio stream processing (ASP) block $722_2$ and then performs pulse code modulation (PCM) encode (PCE) at PCE block $723_2$ on the second block of input data. Buffer $711_4$ is being filled with a fourth block of input data during time block 704.

During time block 705, data stored in buffer $711_2$ is output to D/A converter and analog output 113. CPU 101 performs decode (DEC) block $721_3$ on the third block of data, then performs audio stream processing (ASP) $722_3$ on the third block of data. CPU 101 next performs pulse code modulation (PCM) encode (PCE) at PCE block $723_3$ on the third block of input data. The data from this operation is stored in output buffer $712_3$. CPU 101 then executes decode (DEC) block $721_4$ on the fourth block of data. Buffer $711_5$ is being filled with the fifth block on input data.

During time block 706, data stored in buffer $712_3$ is output to D/A converter and analog output 113. CPU 101 performs audio stream processing (ASP) $722_4$ and then performs pulse code modulation (PCM) encode (PCE) at PCE block $723_4$ on the fourth block of input data.

Figure 8:
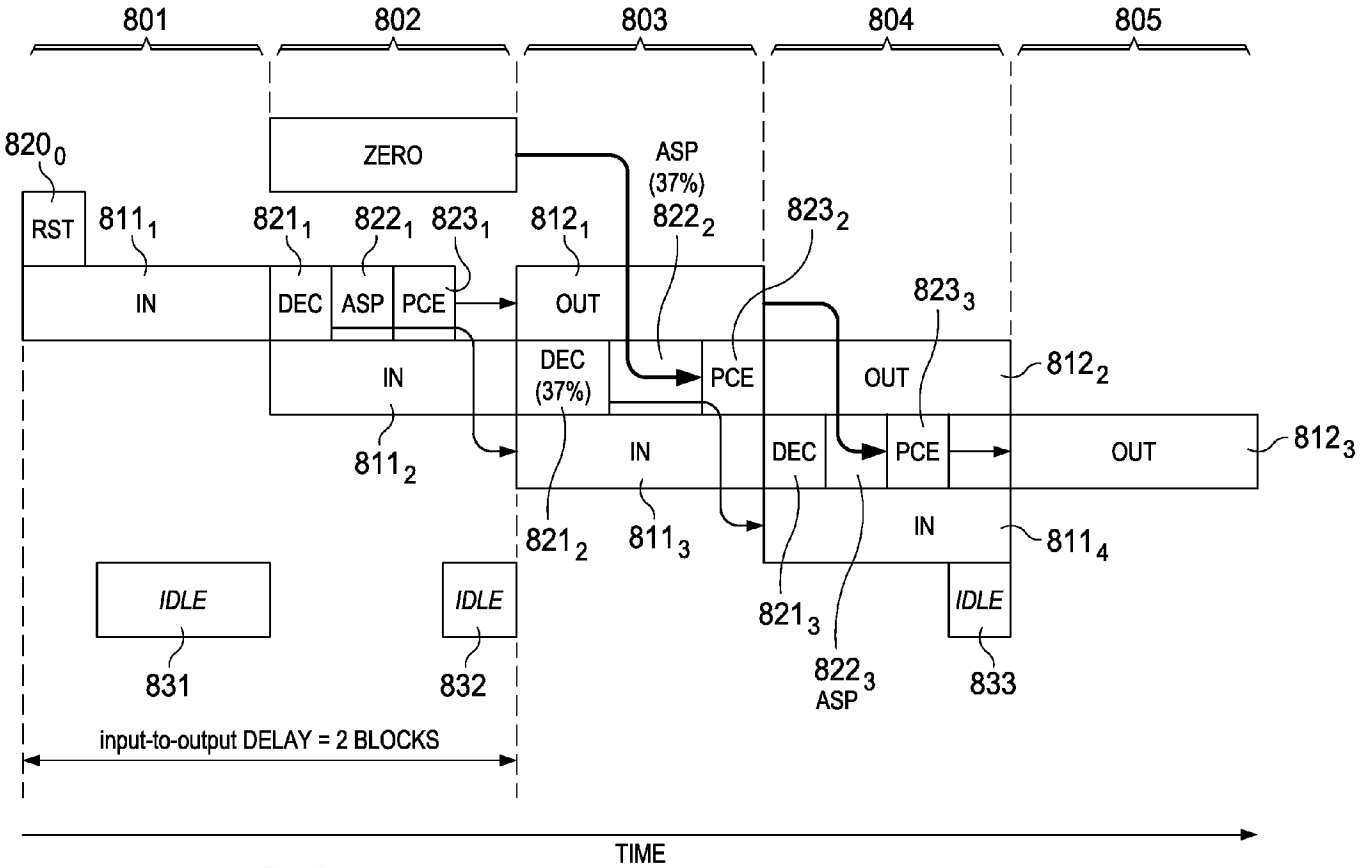
FIG. 8 (PRIOR ART)
FIG. 8 illustrates an example schedule with the output buffer pre-loaded with one block reducing system latency by one block in a two block buffer case.

The preceding examples of FIGS. 4 to 7 illustrate methods enabling higher peak instruction cycles without improving system latency. The system latency in each of these three examples is three blocks. FIG. 8 illustrates a prior art example with only two blocks of latency. Processing in FIG. 8 begins with one block sized buffer receiving input data and one zero filled block sized buffer for output. Starting output with a single block of zeros in output buffer reduces the system latency in FIG. 8 to $\Delta_{IO}$ as follows:

$$\Delta_{IO}=2N/f_s$$

During time block 801, a first buffer $811_1$ receives and stores input data. CPU 101 performs reset (RST) at block $820_0$ and is idle during the remainder time block 801 as indicated by idle block 831.

During time block 802, CPU 101 executes decode (DEC) block $821_1$. This involves reading data from buffer $811_1$ as illustrated in FIG. 8. CPU 101 next executes audio stream processing (ASP) block $822_1$. CPU 101 next executes the pulse code modulation encode (PCE) at PCE block $823_1$. This involves further processing on data from decode (DEC) block $821_1$ and audio stream processing (ASP) block $822_1$. As illustrated in FIG. 8 data from PCE block $823_1$ is stored in buffer $812_1$. CPU 101 is idle (or executing background processing) for the last of time block 802 as shown at idle block 832. Buffer $811_1$ is being filled with a second block of input data during time block 802.

During time block 803, data stored in buffer $812_1$ is output to D/A converter and analog output 113. CPU 101 executes DEC block $821_2$ followed by ASP block $822_2$ on the second block of input data. CPU 101 then executes PCE block $823_2$ on this second block of input data. Buffer $811_3$ is being filled with a third block of input data during time block 803.

During time block 804, data stored in buffer $812_2$ is output to D/A converter and analog output 113. CPU 101 performs DEC block $821_3$ followed by ASP block $822_3$ on the third block of input data. CPU 101 then executes PCE block $823_3$ on this third block of input data. CPU 101 is idle during idle block 833. Buffer $811_4$ is being filled with a fourth block of input data during time block 804.

Figure 9A:
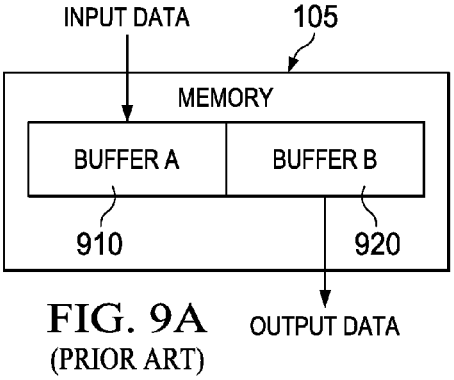
FIG. 9A (PRIOR ART)
FIGS. 9A and 9B illustrate respective examples of use of the two sample block buffers in the example illustrated in FIG. 8.
Figure 9B:
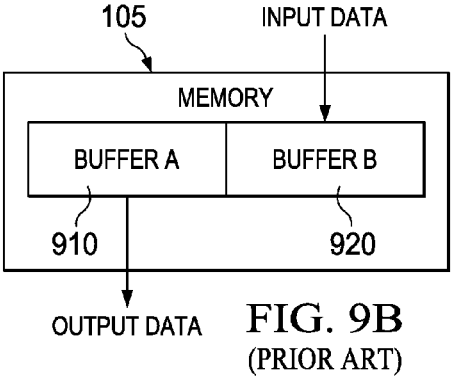
FIG. 9B (PRIOR ART)

FIGS. 9A and 9B illustrate an example of a prior art technique managing input and output buffers for the two block latency case of FIG. 8. FIG. 9A illustrates data movement during a first time block. FIG. 3A illustrates buffer A 910 and buffer B 920 are formed as part of DRAM 105. During the first time block input data is written into buffer A 910 and output data is read from buffer B 920. FIG. 9B illustrates data movement during a second time block as input data is written into buffer B 920 and output data is read from buffer A 910. This pattern repeats in FIG. 9A for the third time block. As shown in FIGS. 9A and 9B one buffer is used for input and one buffer is used for output.

FIG. 8 illustrates that only a modest peak in DEC plus ASP instruction cycles can be tolerated with the latency reduced from three to two blocks. The input and output buffers employed are again assumed have to hold two N-sample blocks. No improvement can be achieved with larger buffers.

Figure 10:
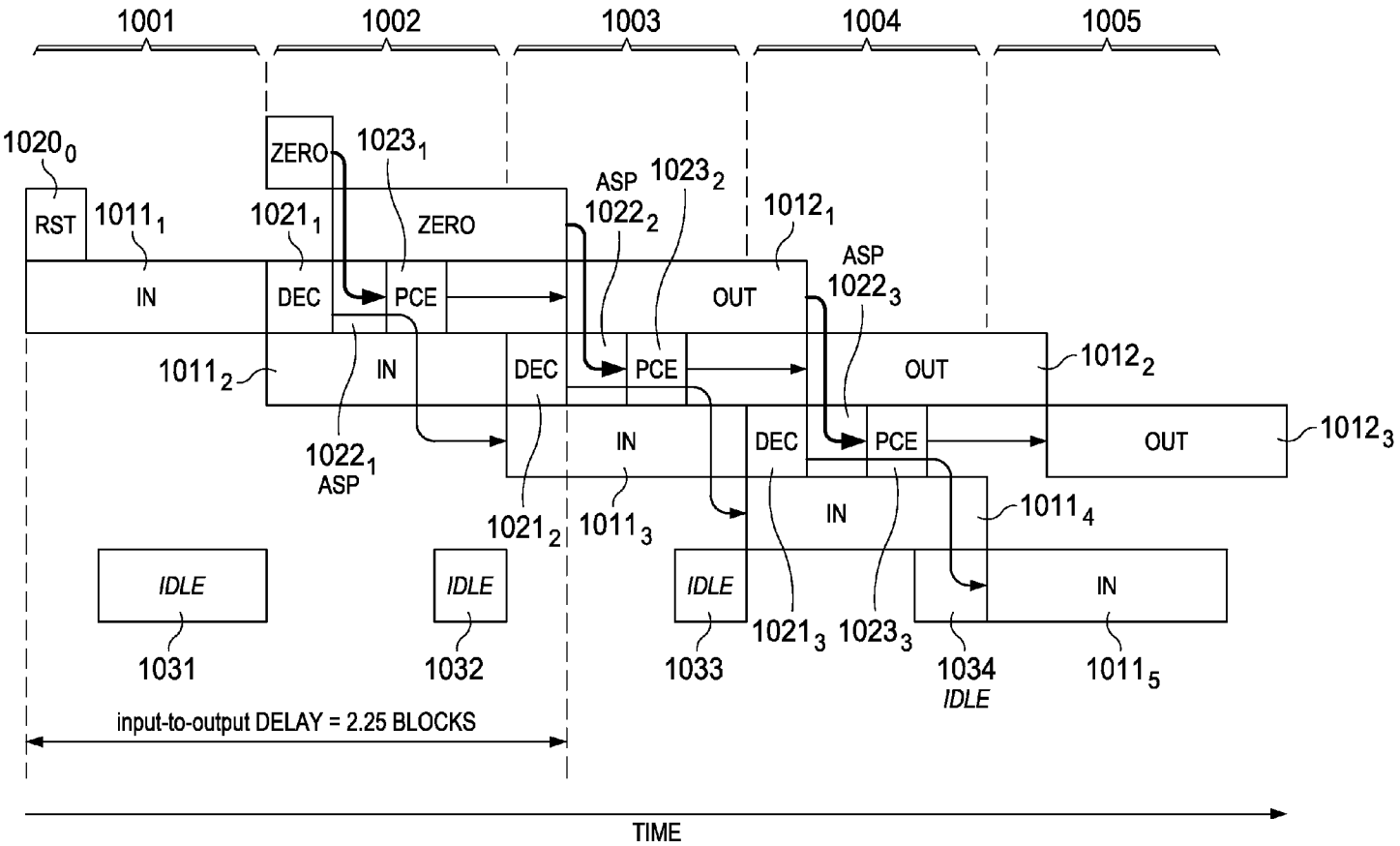
FIG. 10 illustrates an example schedule with the output buffer pre-loaded with 1.25 blocks in accordance with this invention.
Figure 11:
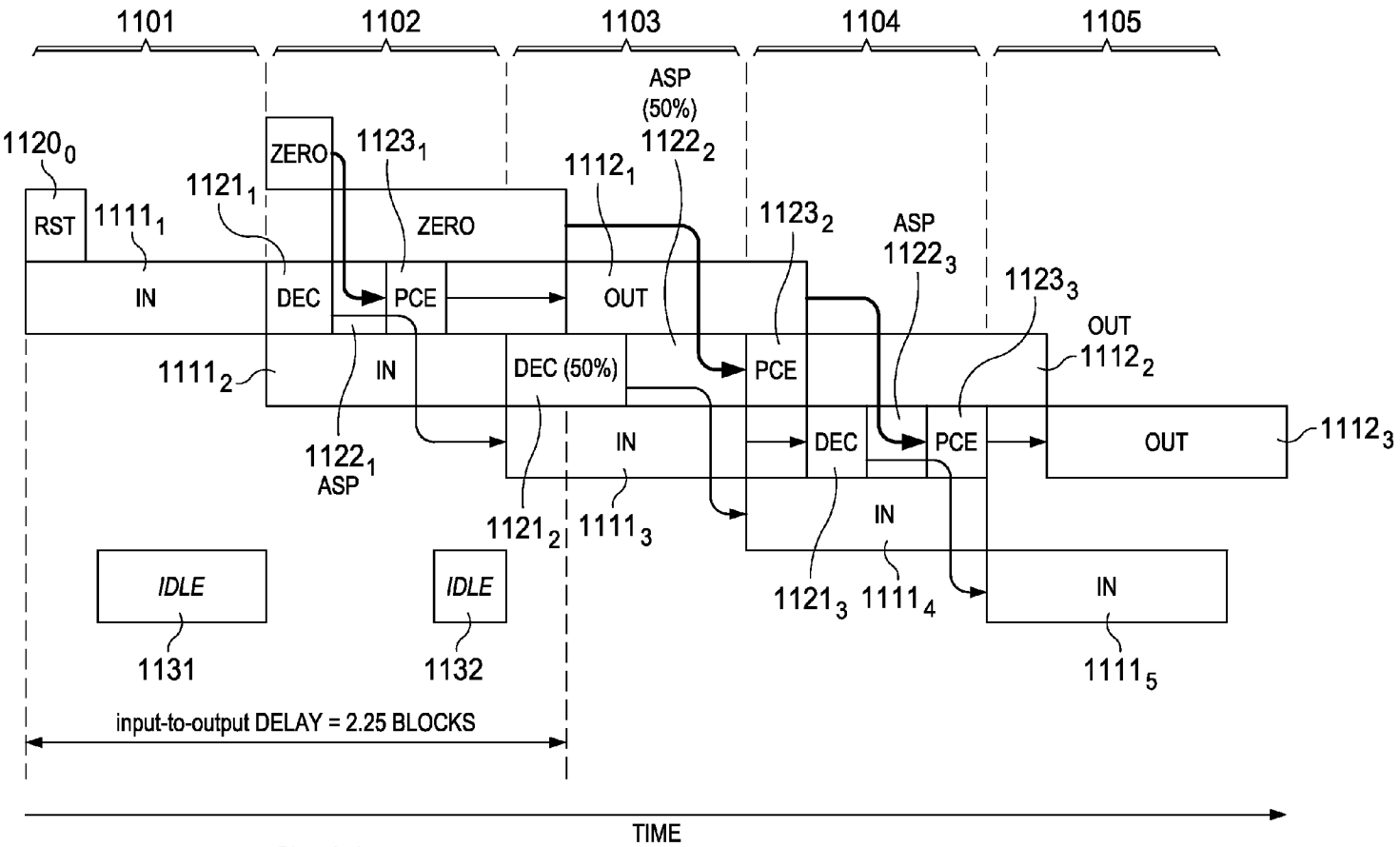
FIG. 11 illustrates an example schedule with the output buffer pre-loaded with 1.25 blocks with the peak MIPS in a subsequent block in accordance with this invention.
Figure 12:
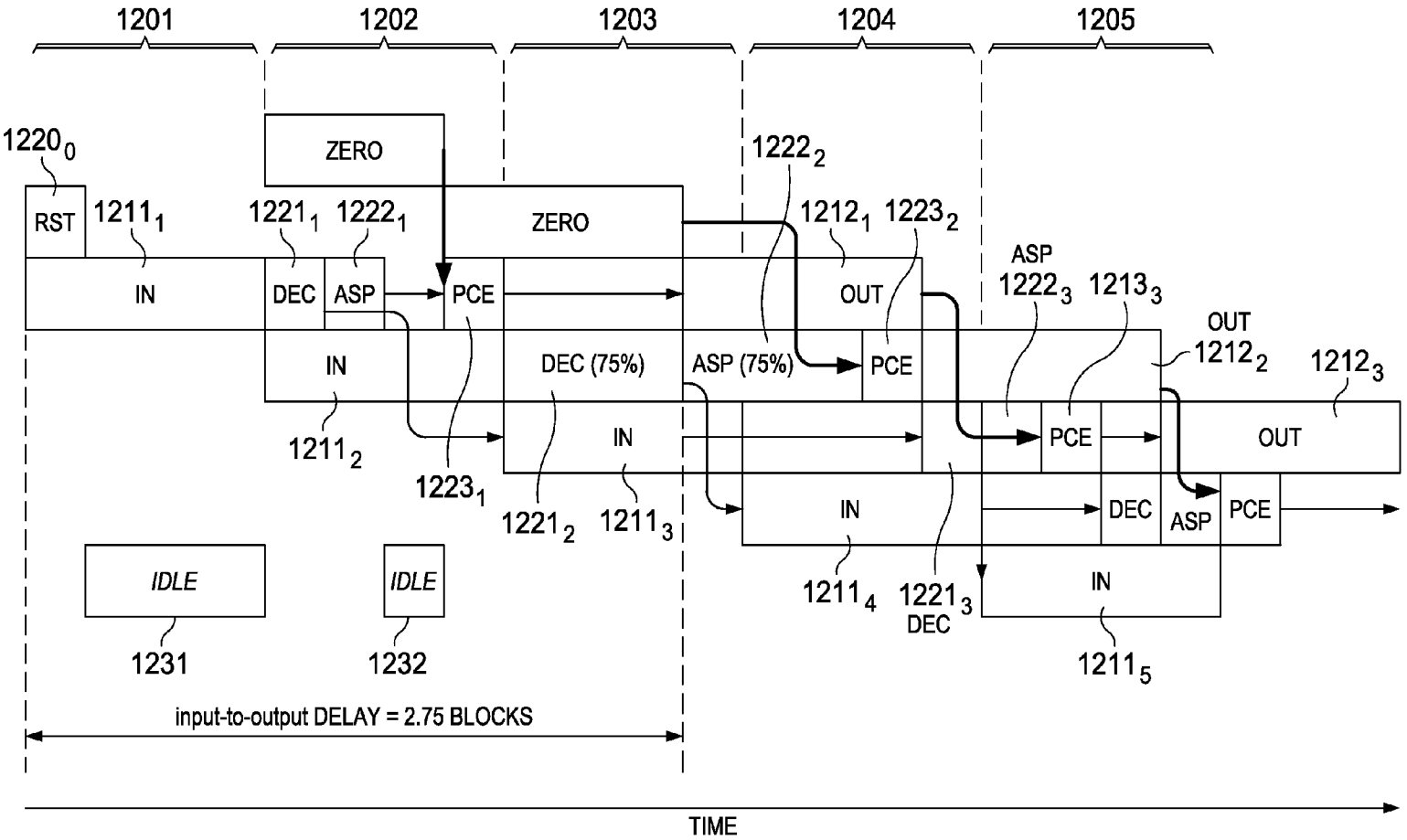
FIG. 12 illustrates an example schedule with the output buffer pre-loaded with 1.75 blocks with peak MIPS in a subsequent block in accordance with this invention.

FIGS. 10 to 12 illustrate examples having one full output buffer and one partially full output buffer on startup. This represents a compromise between high peak instruction cycles enabled by FIG. 7 and the reduced system latency enabled by FIG. 8. One way to achieve this is to use an output buffer which has 1+x output blocks pre-loaded, where $0<x<1$.

FIG. 10 illustrates an example for x=0.25 for the case of uniform instruction cycles. FIG. 11 illustrates an example for x=0.25 for the case of peak instruction cycles.

The input and output buffers employed are again assumed have to hold two N-sample blocks since no improvement can be achieved with larger buffers. The output buffer can no longer be implemented in a simple ping-pong fashion where the output blocks alternate. Some embodiments use a circular buffer. Other embodiments have the first/partial block as a subset of a full block.

The example shown in FIG. 10 is an intermediate technique in terms of both peak instruction cycles and system latency as compared with FIG. 7 and FIG. 8. FIG. 10 illustrates block sized time divisions 1001, 1002, 1003, 1004 and 1005.

During time block 1001, CPU 101 initiates the process via reset (RST) block $1020_0$. CPU 101 is idle for the remainder of time block 1001 as shown by idle block 1031. During time block 1001 input buffer $1011_1$ is filled as previously described.

During time block 1002, CPU 101 executes decode (DEC) block $1021_1$, followed by audio stream processing (ASP) block $1022_1$ and then pulse code modulation encode (PCE) block $1023_1$ upon data from the first block. CPU 101 is idle for the remainder of time block 1002 as shown by idle block 1032. The process requires that decode (DEC) block $1021_1$ completes before the beginning of time block 1003 when the buffer must be clear to receive new data. The process also requires that pulse code modulation encode (PCE) block $1023_1$ complete to provide the data for output to buffer $1012_1$ before the beginning of this output. This output begins 2.25 blocks after the start of input data (beginning of block 1001) within time block 1003. This delay results in a latency of 2.25 time blocks. During time block 1002 input buffer $1011_2$ is being filled.

During time block 1003, CPU 101 executes decode (DEC) block $1021_2$, followed by audio stream processing (ASP) block $1022_2$ and then pulse code modulation encode (PCE) block $1023_2$ upon data from the second input block. CPU 101 is idle for the remainder of time block 1003 as shown by idle block 1033. The process requires that decode (DEC) block $1021_2$ complete before the beginning of time block 1004 when the buffer must be clear to receive new data. The process also requires that pulse code modulation encode (PCE) block $1023_2$ complete to provide the data for output to buffer $1012_2$ before the beginning of this output. This output begins 3.25 blocks after the start of input data (beginning of block 1001) within time block 1004. During time block 1003 input buffer $1011_3$ is being filled.

During time block 1004, CPU 101 executes decode (DEC) block $1021_3$, followed by audio stream processing (ASP) block $1022_3$ and then pulse code modulation encode (PCE) block $1023_3$ upon data from the third input block. CPU 101 is idle for the remainder of time block 1003 as shown by idle block 1034. The process requires that decode (DEC) block $1021_3$ complete before the beginning of time block 1005 when the buffer must be clear to receive new data. The process also requires that pulse code modulation encode (PCE) block $1023_3$ complete to provide the data for output by buffer $1012_3$ before the beginning of this output. This output begins 4.25 blocks after the start of input data (beginning of block 1001) within time block 1005. Data output from buffer $1012_2$ to D/S converter and analog controller 113 begins in block 1003. This output completes during block 1004. During time block 1004 input buffer $1011_4$ is being filled.

The example shown in FIG. 11 is the intermediate technique in terms of both peak instruction cycles and system latency illustrating peak instruction cycle capability. FIG. 11 illustrates block sized time divisions 1101, 1102, 1103, 1104 and 1105.

During time block 1101, CPU 101 initiates the process via reset (RST) block $1120_0$. CPU 101 is idle for the remainder of time block 1101 as shown by idle block 1131. During time block 1101 buffer $1111_1$ is filled as previously described.

During time block 1102, CPU 101 executes decode (DEC) block $1121_1$, followed by audio stream processing (ASP) block $1122_1$ and then pulse code modulation encode (PCE) block $1123_1$ upon data from the first block. CPU 101 is idle for the remainder of time block 1102 as shown by idle block 1132. The process requires that decode (DEC) block $1121_1$ completes before the beginning of time block 1103 when the buffer must be clear to receive new data. The process also requires that pulse code modulation encode (PCE) block 1123$_1$ completes to provide the data for output by buffer 1112$_1$ before the beginning of this output. This output begins 2.25 blocks after the start of input data (beginning of block 1101) within time block 1103. This delay results in a latency of 2.25 time blocks. During time block 1102 input buffer 1111$_2$ is being filled.

During time block 1103, CPU 101 executes decode (DEC) block 1121$_2$, followed by audio stream processing (ASP) block 1122$_2$ upon data from the second block. FIG. 11 illustrates that decode (DEC) block 1121$_2$ and audio stream processing (ASP) block 1122$_2$ are extended relative to their counterparts in FIG. 10. These two processes fill the capacity of CPU 101 during time block 1103 leaving no idle time. The process requires that decode (DEC) block 1121$_2$ complete before the beginning of time block 1104 when the buffer must be clear to receive new data. Data output from buffer 1112$_1$ to D/S converter and analog controller 113 begins in block 1103. This output completes during block 1104. During time block 1103 input buffer 1111$_3$ is being filled.

During time block 1104, CPU 101 executes pulse code modulation encode (PCE) block 1123$_2$ filling output buffer 1112$_2$. The process requires that pulse code modulation encode (PCE) block 1123$_2$ complete to provide the data for output from buffer 1112$_2$ before the beginning of this output. This output begins 3.25 blocks after the start of input data (beginning of block 1101) within time block 1104. CPU 101 then executes decode (DEC) block 1121$_3$, followed by audio stream processing (ASP) block 1122$_3$ and then pulse code modulation encode (PCE) block 1123$_3$ upon data from the third input block. The process requires that decode (DEC) block 1121$_3$ complete before the beginning of time block 1105 when the buffer must be clear to receive new data. The process also requires that pulse code modulation encode (PCE) block 1123$_3$ complete to provide the data for output at 1112$_3$ before the beginning of this output. This output begins 4.25 blocks after the start of input data (beginning of block 1101) within time block 1105. During time block 1104 input buffer 1111$_4$ is being filled.

FIG. 12 illustrates an example with a larger partial block of size x=0.75. This enables both higher peak instruction cycles and lower latency as compared with FIG. 5. When the example of FIG. 4 is improved with more memory as in FIG. 5, a higher peak instruction cycles for same latency as than FIG. 4 is enabled.

During time block 1201, CPU 101 initiates the process via reset (RST) block 1220$_0$. CPU 101 is idle for the remainder of time block 1201 as shown by idle block 1231. During time block 1201 input buffer 1211$^1$ is filled as previously described.

During time block 1202, CPU 101 executes decode (DEC) block 1221$_1$, followed by audio stream processing (ASP) block 1222$_1$ and then pulse code modulation encode (PCE) block 1223$_1$ upon data from the first block. CPU 101 is idle for the remainder of time block 1202 between the end of ASP block 1222$_1$ and the beginning of PCE block 1223$_1$ as shown by idle block 1232. The process requires that decode (DEC) block 1221$_1$ completes before the beginning of time block 1203 when the buffer must be clear to receive new data. The process also requires that pulse code modulation encode (PCE) block 1223$_1$ completes within time block 1203 to provide the data for output at buffer 1212$_1$ before the beginning of this output. This output begins 2.75 blocks after the start of input data (beginning of block 1201) within time block 1203. This delay results in a latency of 2.75 time blocks. During time block 1202 input buffer 1211$_2$ is being filled.

During time block 1203, CPU 101 executes decode (DEC) block 1221$_2$, then begins audio stream processing (ASP) block 1222$_2$ upon data from the second input block. FIG. 12 illustrates that decode (DEC) block 1221$_2$ and audio stream processing (ASP) block 1222$_2$ are extended relative to their counterparts in FIG. 10. These two processes fill the capacity of CPU 101 during time block 1203 leaving no idle time. The process requires that decode (DEC) block 1221$_2$ complete before the beginning of time block 1204 when the buffer must be clear to receive new data. During time block 1203 buffer 1211$_3$ is being filled.

During time block 1204, CPU 101 completes audio stream processing (ASP) 1222$_2$ then executes pulse code modulation encode (PCE) block 1223$_2$ on the second block of data filling buffer 1212$_2$. The process requires that pulse code modulation encode (PCE) block 1223$_2$ complete to provide the data for output by buffer 1212$_2$ before the beginning of this output. This output begins 3.75 blocks after the start of input data (beginning of block 1201) within time block 1204. CPU 101 then executes decode (DEC) block 1221$_3$ on the third block of data. The process requires that decode (DEC) block 1221$_3$ is completed before the end of time block 1204 so that a buffer is available for input data. CPU 101 is completely used during time block 1204 leaving no idle block. During time block 1204 input buffer 1211$_4$ is being filled.

Figure 13:
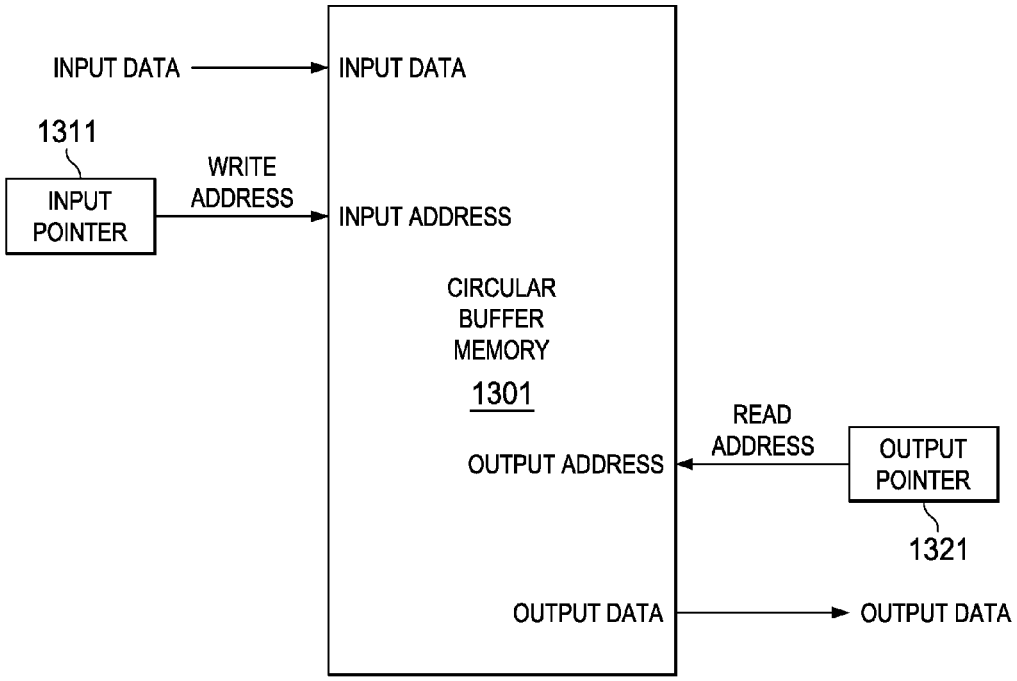
FIG. 13 (PRIOR ART)
FIG. 13 illustrates an example of a prior art circular buffer suitable for use with this invention.

FIG. 13 illustrates a prior art memory buffer technique which is useful in this invention. FIG. 13 illustrates a circular buffer memory 1301 with separate input and output address pointers for corresponding separate input and output ports. Input pointer 1311 stores the address for the next data input within circular buffer memory 1301. Upon receipt of the next input data at the input port, the circular buffer memory 1301 stores this data at the address stored in input pointer 1311. Input pointer 1311 is updated to a next input address upon this data input. The exact amount of this address update depends upon the relationship of the amount of data input at one time and the minimum addressable data size in circular buffer memory 1301. It is known in the art that memories generally are byte addressable, that is, each address of circular buffer memory 1301 identifies a single byte (8 bits) of data. The minimum data transferred on input may be much more than a single byte and the increment of input pointer 1311 is adjusted accordingly.

Circular buffer memory 1301 is circular in storage address. Continued incrementing input pointer 1311 eventually reaches and exceeds the last memory address in circular buffer memory 1301. Upon reaching the end of the memory addresses, input pointer 1311 wraps around to the beginning addresses of circular buffer memory 1311.

A similar process occurs for output. Upon an output command circular buffer memory 1301 supplies the data stored at the address of the output address port (supplied from output pointer 1321) to the output port. Output pointer 1321 is incremented in an amount corresponding to the output data width. Output pointer 1321 circularly wraps around for the end of circular buffer memory 1301 addresses to the beginning addresses are previously described for input pointer 1311. The storage capacity of circular buffer memory 1301 must be large enough to accommodate the 2+x delay from input to output illustrated in FIGS. 10, 11 and 12 where $0<x<1$.

Figure 14:
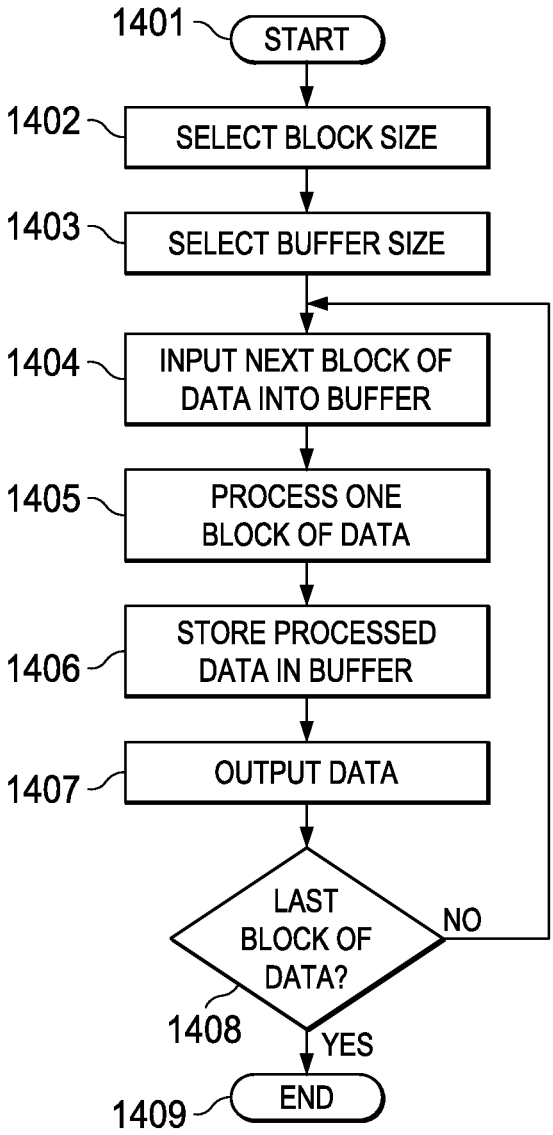
FIG. 14 is a flow chart of an example of the process of this invention.

FIG. 14 is a flow chart of the method of this invention. This method begins with start block 1401. The first substantive action selects the block size in block 1402. The selection of the block size is based upon the capacity of the central processing unit employed for the audio processing task. The audio processing of this method is typically a long chain of serial operations on each data sample. These serial operations are generally of different character requiring differing computational resources and different constants for execution. Thus serial execution on each data sample would involve too frequent context switches involving too much memory traffic for instructions and constants. This method employs batch processing. The central processing unit executes one or more of the serial steps on group of data samples before switching context to perform a next serial step or steps on the same batch. This results in more effective utilization of computational resources.

The method selects the buffer size in block 1403. According to this invention the buffer size is 2+x delay of the block size where 0<x<1. The particular x selected provides a desired combination of total delay and adaptability to peak processing requirements.

Block 1404 inputs the next block of data into an input buffer. For the first iteration of this loop the next data is the first data. This is described above in conjunction with FIGS. 2, 4 to 8 and 10 to 12.

Block 1405 performs the required data processing of the method on one block of data. As described above in conjunction with FIGS. 2, 4 to 8 and 10 to 12 this typically includes decode (DEC), audio stream processing (ASP) and pulse code modulation encode (PCE). The processed data is stored in an output buffer in block 1406. This data is output in block 1407. In the example system illustrated in FIG. 1, this output supplies data to D/A converter and analog output 113 for driving speaker 123. Speaker 123 thus generates sounds corresponding to the originally coded input data.

Decision block 1408 tests to determine if the block of data of the current iteration of the loop is the last block of data. If this is not the last block of data (No at decision block 1408), then the method returns to block 1404 to input the next block of data. If this is the last block of data (Yes at decision block 1408), then the method is complete and terminates at end block 1409.

As shown in FIG. 14 change of the block size and the buffer size will remain unchanged for iterations of the loop including blocks 1404, 1405, 1406, 1407 and 1408. The block size is typically selected based upon the processing to be performed by CPU 101 relative to the available computational capacity. This is not expected to change with loop iterations. Likewise the buffer size which controls the total delay of the decoder. The fractional size x is selected to provide greater peak computational capacity than the two block buffer case (FIG. 8) and a smaller total delay than the three block buffer case (FIGS. 2 and 4 to 7). This selection is not expected to change with loop iterations.

What is claimed is:

1. A method of processing encoded audio data comprising:

receiving encoded audio data;

storing said received encoded audio data in a memory buffer including storing each input minimum amount of data transferred of said received encoded audio data at an address location within the memory buffer stored in an input address pointer, and incrementing said input address pointer to a next address location within the memory buffer for storing a next input minimum amount of data transferred, upon reaching a greatest address location within the memory buffer said input address pointer circularly wrapping to a least address location within the memory buffer;

upon storing each time block of a predetermined time block size of received encoded audio data, recalling the block of said stored encoded audio data;

sizing the memory buffer to store 2+x number of time blocks of audio data, where x is a predetermined constant and 0<x<1;

performing at least one data processing operation upon each recalled block of encoded audio data thereby forming decoded audio data;

storing each processed block of decoded audio data in the memory buffer;

recalling decoded audio data from the memory buffer, said recalling occurring 2+x number of time blocks following said step of storing corresponding received encoded audio data including recalling each output minimum amount of data transferred of said decoded audio data from an address location within the memory buffer stored in an output address pointer, and incrementing said output address pointer to a next address location within the memory buffer for recalling a next output minimum amount of data transferred, upon reaching the greatest address location within the memory buffer circularly said output address pointer wrapping to the least address location within the memory buffer; and generating sound corresponding to said recalled decoded audio data.

2. The method of claim 1, wherein:

said step of performing at least one data processing operation upon each recalled block of encoded audio data includes decoding and decompressing said recalled block of encoded audio data.

3. The method of claim 1, wherein:

said step of performing at least one data processing operation upon each recalled block of encoded audio data includes audio stream processing said recalled block of encoded audio data.

4. The method of claim 1, wherein:

said step of performing at least one data processing operation upon each recalled block of encoded audio data includes pulse width modulation encoding of said recalled block of encoded audio data.

5. The method of claim 4, wherein:

said step of generating sound corresponding to said recalled decoded audio data includes converting said pulse with modulation encoded audio data from digital data to an analog audio signal, and converting said analog audio signal into sound via a transducer.

6. An encoded audio data apparatus comprising:

a volatile memory;

a central processing unit connected to said volatile memory, said central processing unit including an input address pointer and an output address pointer, said central processing unit programmed to define a circular memory buffer within said volatile memory, store an input minimum amount of data transferred of encoded audio data into said circular memory buffer at an address location within said circular memory buffer stored in said input address pointer, and increment said input address pointer to a next address location within said circular memory buffer for storing a next input minimum amount of data transferred, upon reaching a greatest address location within said circular memory buffer said input address pointer circularly wrapping to a least address location within said circular memory buffer, upon storing each time block of a predetermined time block size of encoded audio data, recall the block of said stored encoded audio data, perform at least one programmed data processing operation upon each recalled block of encoded audio data thereby forming decoded audio data, store each processed block of decoded audio data in said circular memory buffer;

recall an output minimum amount of data transferred of decoded audio data from said circular memory buffer from an address location within said circular memory buffer stored in said output address pointer, said recall occurring 2+x number of time blocks following storing corresponding received encoded audio data, where x is a predetermined constant and $0<x<1$, and increment said output address pointer to a next address location within said circular memory buffer for recalling a next output minimum amount of data transferred, upon reaching the greatest address location within said circular memory buffer circularly wrapping said output address pointer to the least address location within said circular memory buffer; and a digital to analog converter connected to said circular memory buffer receiving decoded audio data recalled from said circular memory buffer, said digital to analog converter converting said recalled decoded audio data into an analog audio signal.

7. The encoded audio data apparatus of claim 6, wherein:

said central processing unit is programmed to perform at least one data processing operation upon each recalled block of encoded audio data including programming to decode and decompress said recalled block of encoded audio data.

8. The encoded audio data apparatus of claim 6, wherein:

said central processing unit is programmed to perform at least one data processing operation upon each recalled block of encoded audio data including programming to perform audio stream processing said recalled block of encoded audio data.

9. The encoded audio data apparatus of claim 6, wherein:

said central processing unit is programmed to perform at least one data processing operation upon each recalled block of encoded audio data including programming to perform pulse width modulation encoding of said recalled block of encoded audio data.

10. The encoded audio apparatus of claim 6, further comprising:

a transducer connected to said digital to analog converter, said transducer converting said analog audio signal into sound.

11. The encoded audio apparatus of claim 6, further comprising:

a nonvolatile memory connected to said central processing unit storing at least one file including encoded audio data; and wherein said central processing unit is further programmed to transfer encoded audio data from said nonvolatile memory to said circular memory buffer.

12. The encoded audio apparatus of claim 6, further comprising:

an input/output controller connected to said central processing unit and adapted for connection to a data network for receiving encoded audio data; and wherein said central processing unit is further programmed to transfer encoded audio data from said input/output controller to said circular memory buffer.

13. The encoded audio apparatus of claim 6, further comprising:

a read only nonvolatile memory connected to said central processing unit storing program instructions adapted to control said central processing unit; and wherein said central processing unit is adapted to recall program instructions from said read only nonvolatile memory and execute data processing operations corresponding to said recalled program instructions.

* * * * *